US006860120B1

(12) United States Patent
Celeste et al.

(10) Patent No.: US 6,860,120 B1
(45) Date of Patent: Mar. 1, 2005

(54) STITCHING APPARATUS FOR FORMING A CUT PILE SURFACE STRUCTURE

(75) Inventors: Richard James Celeste, Newark, DE (US); John Edwin Gantzhorn, Hockessin, DE (US); Paul Felix Pustolski, Newark, DE (US); Dimitri Peter Zafiroglu, Wilmington, DE (US)

(73) Assignee: Invista North America S.A.R.L., Wilmington, DE (US)

( * ) Notice: Subject to any disclaimer, the term of this patent is extended or adjusted under 35 U.S.C. 154(b) by 0 days.

(21) Appl. No.: 10/473,701

(22) PCT Filed: May 14, 2002

(86) PCT No.: PCT/US02/18396

§ 371 (c)(1),
(2), (4) Date: Sep. 29, 2003

(87) PCT Pub. No.: WO02/092896

PCT Pub. Date: Nov. 21, 2002

Related U.S. Application Data

(60) Provisional application No. 60/291,382, filed on May 16, 2001.

(51) Int. Cl.[7] ..... D04B 11/00

(52) U.S. Cl. ..... 66/83

(58) Field of Search ..... 66/91, 93, 104, 66/107, 109, 83, 84, 85, 86, 87, 195, 190, 191, 192

(56) References Cited

U.S. PATENT DOCUMENTS 3,603,114 A * 9/1971 Jaskulski et al. ..... 66/85 A
3,677,206 A * 7/1972 Maclsaac et al. ..... 112/80.52

* cited by examiner

*Primary Examiner*—Danny Worrell
(74) *Attorney, Agent, or Firm*—Connolly Bove Lodge & Hutz LLP; Myon K. Wyche

(57) ABSTRACT

A unitary sinker finger is attached at its first end to a sinker bar. In a first embodiment the second end of the finger is attached to a fixed support member. The sinker finger has a loop formation region and a loop cutting region disposed thereon, with the loop cutting region being disposed intermediate the loop formation region and the second end of the finger. A cutting blade that is operable in the cutting region for cutting pile loops formed on the loop formation region of the finger. In a second embodiment the sinker finger is an arcuate member that cantilevers from the sinker bar. A loop cutter cooperates with the arcuate sinker finger to cut the pile loops formed on the finger at a location adjacent to the free end of the finger. A sensing arrangement for determining operability of the cutting arrangement is also disclosed.

28 Claims, 11 Drawing Sheets

STITCHING APPARATUS FOR FORMING A CUT PILE SURFACE STRUCTURE

This application claims the benefit of provisional Application No. 60/291,382, filed May 16, 2001.

BACKGROUND OF THE INVENTION

1. Field of the Invention

The present invention relates to various improvements to a stitching apparatus for forming a pile surface structure having cut pile elements.

2. Description of the Prior Art

Published application WO 00/52246, the PCT counterpart of co-pending U.S. application Ser. No. 09/260,749, filed Mar. 2, 1999 and assigned to the assignee of the present invention, discloses a stitching apparatus for producing a pile surface structure. The apparatus includes a sinker bar from which extend a plurality of sinker fingers. The pile surface structure is initially formed with an array of loop pile elements disposed over the surface of a backing. The loops are defined by drawing a pile yarn over the sinker fingers and attaching the loops to the surface of the backing with a stitching thread.

As disclosed in the referenced published application it is sometimes desirable to sever the loop pile elements to define cut pile elements. Accordingly, it is believed advantageous to provide a stitching apparatus having various improvements therein operable to cut the pile loop elements to form a pile surface structure having cut pile elements.

SUMMARY OF THE INVENTION

In a first embodiment the present invention is directed to a stitching apparatus having a unitary sinker finger attached at its first end to a sinker bar and at its second end to a fixed support member. The sinker finger has a loop formation region and a loop cutting region disposed thereon, with the loop cutting region being disposed intermediate the loop formation region and the second end of the finger. In this embodiment the sinker finger may be linear or, more preferably, arcuate over at least a portion of its length. The apparatus also includes a cutting blade that is operable in the cutting region for cutting pile loops formed on the loop formation region of the finger. The attachment of the second end of the finger to the fixed support member stabilizes the sinker finger so that the cutting blade may operate in the cutting region of the sinker finger to cut the pile loops.

In a second embodiment of the present invention the apparatus includes a sinker finger that is arcuate over at least a portion of its length mounted in cantilever fashion from the sinker bar. The apparatus in accordance with this embodiment of the present invention includes a loop cutter that cooperates with the arcuate sinker finger at a location adjacent to the free end of the sinker finger to cut pile loops formed on the finger.

In a third embodiment of the present invention is directed to a loop cutter arrangement useful with either linear or arcuate sinker fingers for cutting pile loops formed on the finger. A portion of one lateral surface adjacent to the free end of the sinker finger is recessed to define a depression therein. The free end of a first cutting blade extends into the depression in the lateral surface of the sinker finger. A second cutting blade is reciprocably moveable with respect to the first cutting blade. The first cutting blade may itself be, fixed with respect to the sinker finger or may be reciprocable with respect thereto in a plane generally parallel to the lateral surface of the finger.

A sensing arrangement for indicating the inoperability of the cutter may be used with any embodiment of the stitching apparatus in accordance with the present invention. The sensing arrangement includes a sensing member having a free end thereon. The free end of the sensing member is mounted with respect to the sinker finger for movement from a first, repose, position to a second, signaling, position. In the repose position the free end of the sensing member is disposed adjacent to a sensing point on either the sinker finger or the cutter, as the case may be. The sensing member is responsive to the presence of a pile loop at the sensing point by moving from the repose position to the signaling position. The sensing member has an indicator thereon; movement of the sensing arm to the signaling position disposing the indicator in a location visible to an observer. Alternatively, movement of the sensing arm to the signaling position may be used to actuate an electrical signal apparatus.

BRIEF DESCRIPTION OF THE DRAWINGS

The invention will be more fully understood from the following detailed description, taken in connection with the accompanying drawings, which form a part of this application, and in which.

DETAILED DESCRIPTION OF THE INVENTION

Figure 1:
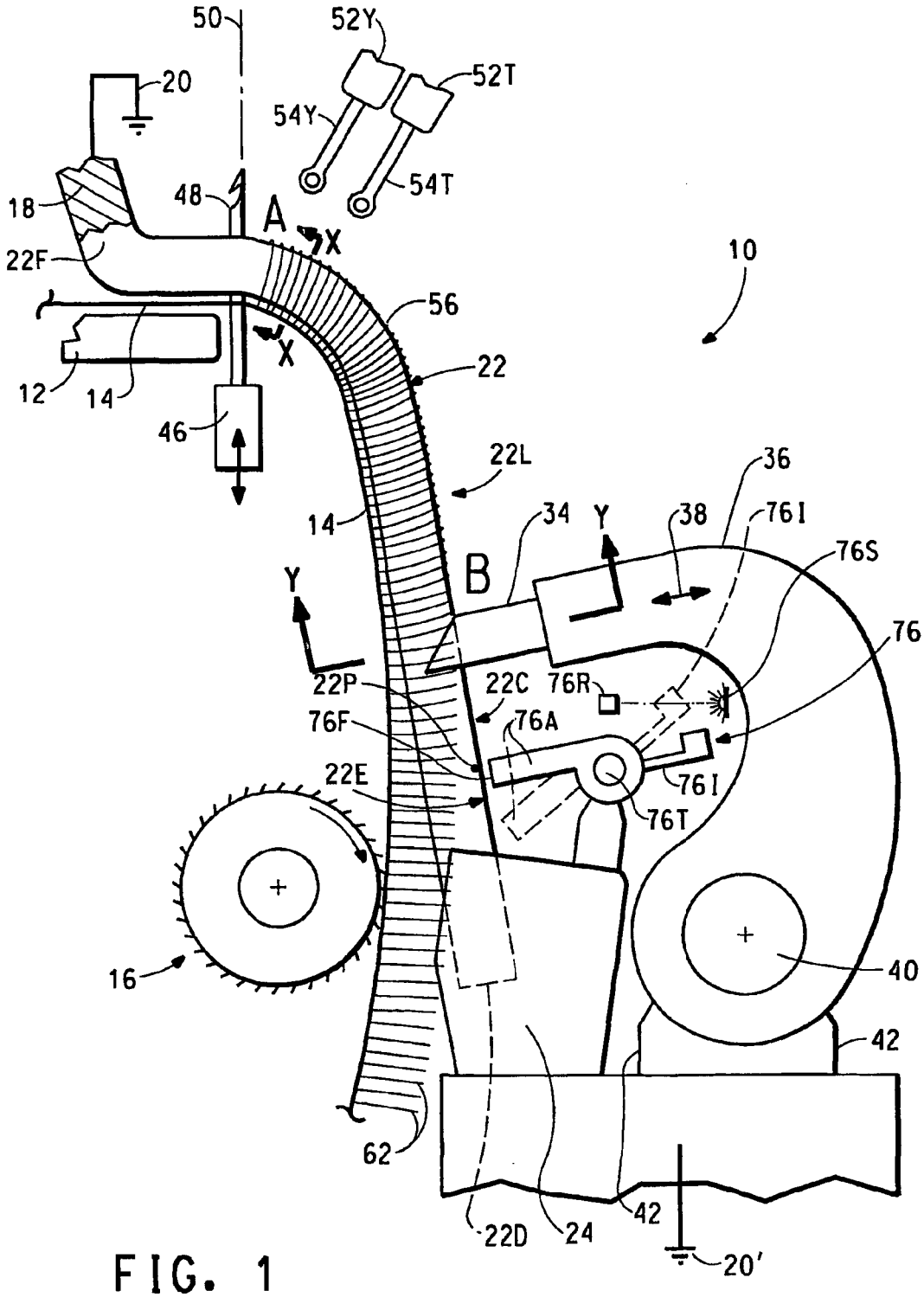
FIG. 1 is a side elevational view of a first embodiment of a stitching apparatus in accordance with the present invention for forming a laid-in, stitched, cut pile yarn surface structure in which the second end of an arcuate sinker finger is attached to a fixed support member.

Throughout the following detailed description similar reference numerals refer to similar elements in all figures of the drawings.

Figure 2:
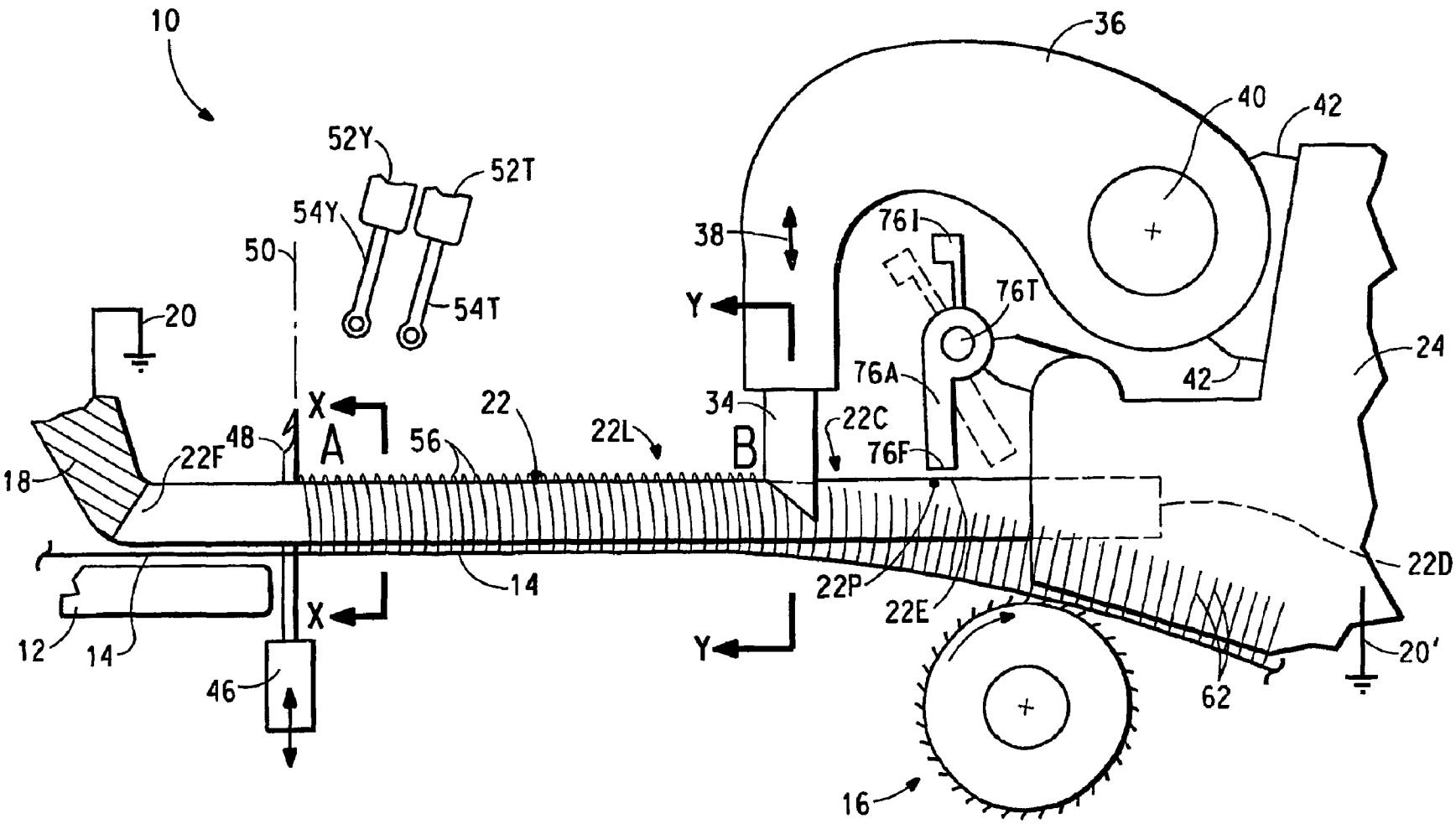
FIG. 2 is a side elevational view illustrating a modification to the first embodiment of the stitching apparatus shown in FIG. 1 in which the sinker finger is generally linear.

FIG. 1 is a side elevational view of a first embodiment of a stitching apparatus generally indicated by the reference character 10 in accordance with the present invention for producing a stitched pile surface structure having cut pile elements over the surface thereof. FIG. 2 is an elevational view of showing a modification of the first embodiment illustrated in FIG. 1.

As may be understood from FIGS. 1 and 2 the stitching apparatus 10 includes a platen 12 that supports a backing 14 as the same is introduced from a supply roll (not shown) into the apparatus 10. The backing 14 may take any suitable form. The backing 14 is incrementally advanced along a path of travel through the apparatus 10 by the action of a drive mechanism generally indicated at reference character 16. The direction of advancement of the backing 14 through the apparatus 10 is termed the "machine direction".

A sinker bar 18 extends transversely across the stitching apparatus 10. The sinker bar 18 is conveniently attached to the framework of the apparatus as indicated diagrammatically by the reference character 20.

A plurality of unitary sinker fingers 22 extends forwardly from the sinker bar 18 in the machine direction of the apparatus. Each sinker finger 22 a first end 22F and a second end 22D thereon. The first end 22F of each sinker finger 22 is attached to and supported by the sinker bar 18. In practice the first end 22F of each sinker finger 22 is usually integrally formed with the sinker bar 18.

As shown in FIG. 1, in the preferred implementation of the first embodiment of the invention each sinker finger 22 is curved, i.e., generally arcuate over at least some portion of its length. In the implementation of the first embodiment shown in FIG. 2 each sinker finger 22 is a generally linear member. The arcuate configuration of the fingers 22 shown in FIG. 1 is preferred, primarily because of the ease of access afforded by the arcuate finger configuration to the stitching mechanisms (i.e., the yarn and thread guide bars to be described).

However, whether the unitary finger 22 has an arcuate or a linear configuration, in accordance with the first embodiment of the present invention illustrated in FIGS. 1 and 2 each sinker finger 22 is rigidly attached at its second end 22D to a support member 24. The support member 24 is itself mounted to 35 the framework of the apparatus 10 at any convenient location, as indicated diagrammatically by the reference character 20', suggesting the mounting of the support member 24 to a portion of the framework of the apparatus 10.

Each sinker finger 22 has a loop formation region 22L and a loop cutting region 22C disposed thereon. The loop formation region 22L is that portion of the sinker finger 22 demarcated in FIGS. 1 and 2 as lying between the reference markers "A" and "B". The loop cutting region 22C is that portion of the sinker finger 22 located on the finger 22 intermediate the loop formation region 22L and the second end 22D of the finger.

Figure 3:
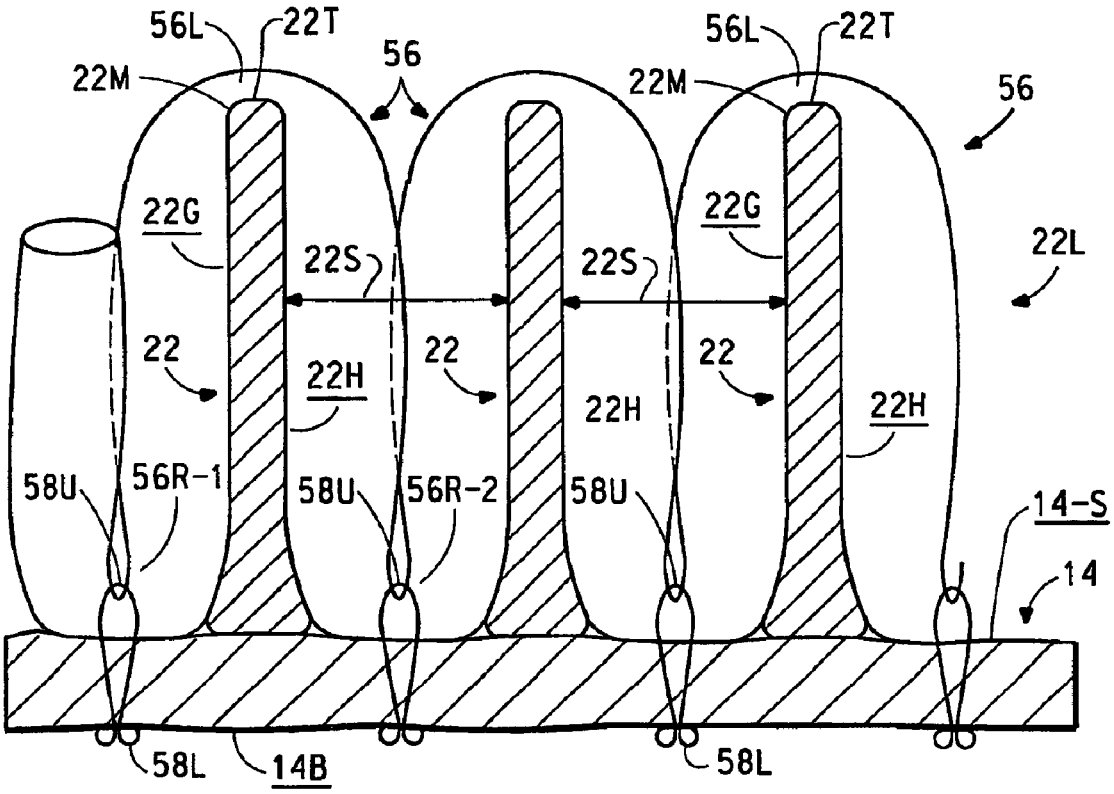
FIG. 3 is a front elevational view taken along view lines X—X in both FIGS. 1 and 2 illustrating the configuration of the sinker fingers in the loop formation region.

As best seen in FIG. 3, in the loop formation region 22L the entire top surface 22T of each sinker finger 22 is preferably smooth and polished to facilitate yarn movement and the formation of pile loops, as will be described. The margins 22M of the top surface 22T of the finger 22 are preferably rounded, as illustrated. The opposed lateral surfaces of the finger 22 are respectively indicated by the reference characters 22G, 22H. The fingers are laterally spaced from each other by a predetermined distance 22S.

Figure 4:
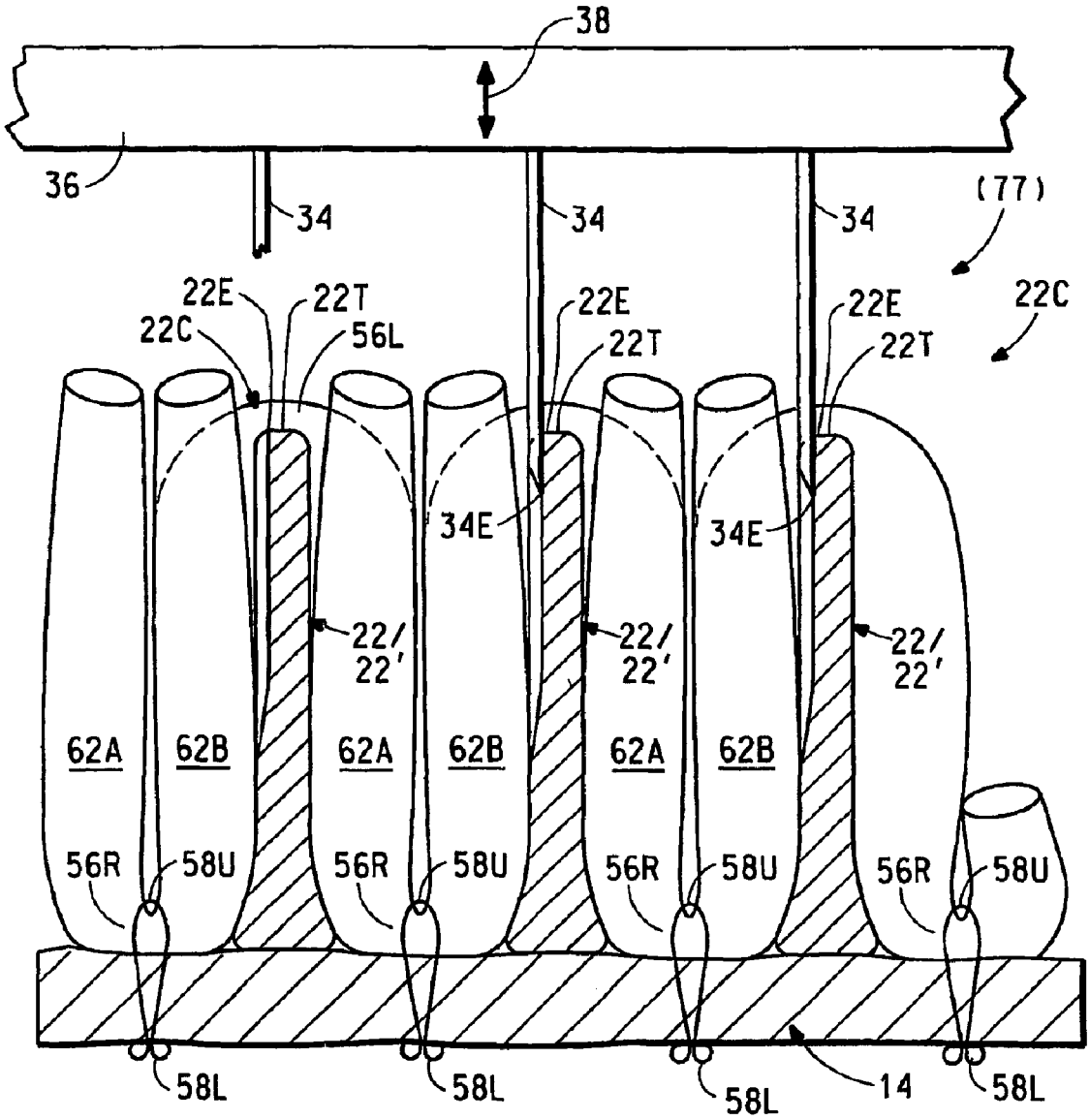
FIG. 4 is a front elevational view taken along view lines Y—Y in both FIGS. 1 and 2 illustrating the operation of a reciprocal cutting blade against the sinker fingers in the loop cutting region.

However, as illustrated in FIG. 4, in the loop cutting region 22C one margin of the finger 22 is sharpened to define a cutting edge 22E extending along the top surface 22T of the finger 22 over a predetermined extent of its length (measured in the machine direction).

The apparatus 10 further includes an array of cutting blades 34 (FIGS. 1 and 2), with each blade 34 in the array being respectively associated with a finger 22 (FIG. 4). Each blade 34 is mounted to a cutting arm 36. The cutting arm 36 is itself mounted for reciprocating movement (in the direction of reference arrows 38) to an actuator 40. The actuator 40 may be conveniently mounted to the framework of the apparatus 10, as indicated diagrammatically at 42.

The stitching apparatus 10 further includes a needle bar 46 having a plurality of hooked needles 48 thereon. The needle bar 46 is mounted forwardly of the platen 12. The needles 48 are displaceable by an actuator (not shown) in vertically reciprocating fashion in a needle plane 50. Each of the reciprocating needles 48 intersects and penetrates the backing 14 at a respective needle penetration point located in the lateral spacing 22S (FIG. 3) defined transversely between adjacent fingers 22.

At least one yarn guide bar 52Y and a thread guide bar 52T are mounted above the sinker fingers 22 and above the path of travel of the backing 14. A guide element 54Y on the yarn guide bar 52Y serves to guide the pile yarn that is laid into the top surface 14S of the backing 14. The guide element 54T on the thread guide bar 52T carries the stitching thread that hold the pile elements 56 (FIG. 3) formed by the yarns to the top surface 14S of the backing. 14. The-pile yarn and the stitching threads are respectively supplied from suitable creels or beams (not shown).

In operation, the backing 14 is introduced into the throat defined between the platen 12 and the undersurface of the sinker fingers 22. The bottom surface 14B of the backing 14 is supported on the platen 12. The backing 14 is conveyed by the wind-up 16 along the path of travel so that successive transversely extending regions of the backing 14 are advanced into the needle plane 50. Before and after the yarn guide bar 52Y is transversely displaced to dispense a length of yarn that eventually forms a pile loop 56 on the surface 14S of the backing 14, the thread guide bars 52T are displaced (by the stitching mechanism, not shown) so that stitching threads from adjacent first and second thread guides 54T on the thread guide bars 52T are successively looped around respective first and second locations on the dispensed length of yarn.

As successive transverse regions of the backing 14 move into the needle plane 50 adjacent first and second needles are actuated and raised through the backing at penetration points to positions above the fingers 22. In the raised positions the adjacent first and second needles respectively successively engage the looped first and the second stitching threads and draw these stitching threads downwardly toward the backing 14. These actions draw the length of dispensed yarn to the surface 14S of the backing 14.

As adjacent first and second needles respectively draw the threads downwardly toward the backing 14 the pile yarn becomes trained over the surface 22T of the sinker finger 22 in the loop formation region 22L, thereby forming a laid-in pile yarn element 56 (FIG. 3) overlying above the first surface of the backing 14. Continued downward movement of each needle through the backing 14 forms an underlap portion 58U of a chain stitch 59. The underlap portion 58U of the stitch 56 from each needle secures the pile yarn element 54 against the first surface 14S of the backing 14. Each stitch 58 also includes an interlockable overlap portion 58L that lies against the bottom surface 14B of the backing 14. Sequential overlap portions 58L interlock with each other, chain-fashion.

As is illustrated in FIG. 3 the pile yarn element 56 has the form of an inverted loop 56L that overlies the top surface 14S of the backing between a first generally U-shaped root portion (e.g., the root 56R-1) located in a first longitudinally extending stitch line and a second generally U-shaped root portion (e.g., the root 56R-2) located in a second longitudinally extending stitch line. Each root portion is held against the top surface 14S of the backing 14 by the underlap portion 58U of one of the stitches 58.

As the backing 14 advances through the apparatus 10 the loops 56L of the pile elements 56 ride on the top surface 22T of the fingers 22 through the loop formation region 22L toward and into the loop cutting region 22C. As may be understood from FIG. 4, in the cutting region 22C the cutting blade 34 mounted to the cutting arm 36 severs the pile loop portion 56L of each pile yarn element 56. In the arrangement illustrated in FIG. 4, as the arm 36 reciprocates in the directions 38 the edge 34E on each cutting blade 34 acts against the cutting edge 22E on a respective finger 22. The cooperative shearing interaction of the edges 22E, 34E on the finger 22 and on the cutting blade 34, respectively, act to sever the pile loop element 56L. This action produces a pair of cut pile branches 62A, 62B (FIG. 4) emanating from each generally U-shaped root portion 56R. The cutting action of the blade arrangement of FIG. 4 occurs from the outside toward the inside of the loop 56L (i.e., from above the loop 56L toward the surface 22T of the finger 22.)

The cutting blade 34 may reciprocate at any desired frequency at least equal to, but preferably exceeding the rate of loop formation. A reciprocating frequency for the blade 34 on the order or two to three times the rate of loop formation is preferred.

The attachment of the second end 22D of each finger 22 to the support member 24 in accordance with the first embodiment of the present invention stabilizes the fingers 22 against the blade 34 and facilitates the cutting of the pile loops.

Severing of the loops 56L frees the backing 14 from the fingers 22. The backing 14 with the cut pile elements indicated by the reference characters 62 in FIGS. 1 and 2 is drawn by the drive mechanism 16 to a suitable wind-up mechanism commonly used in stitching or knitting apparatus.

Figure 5:
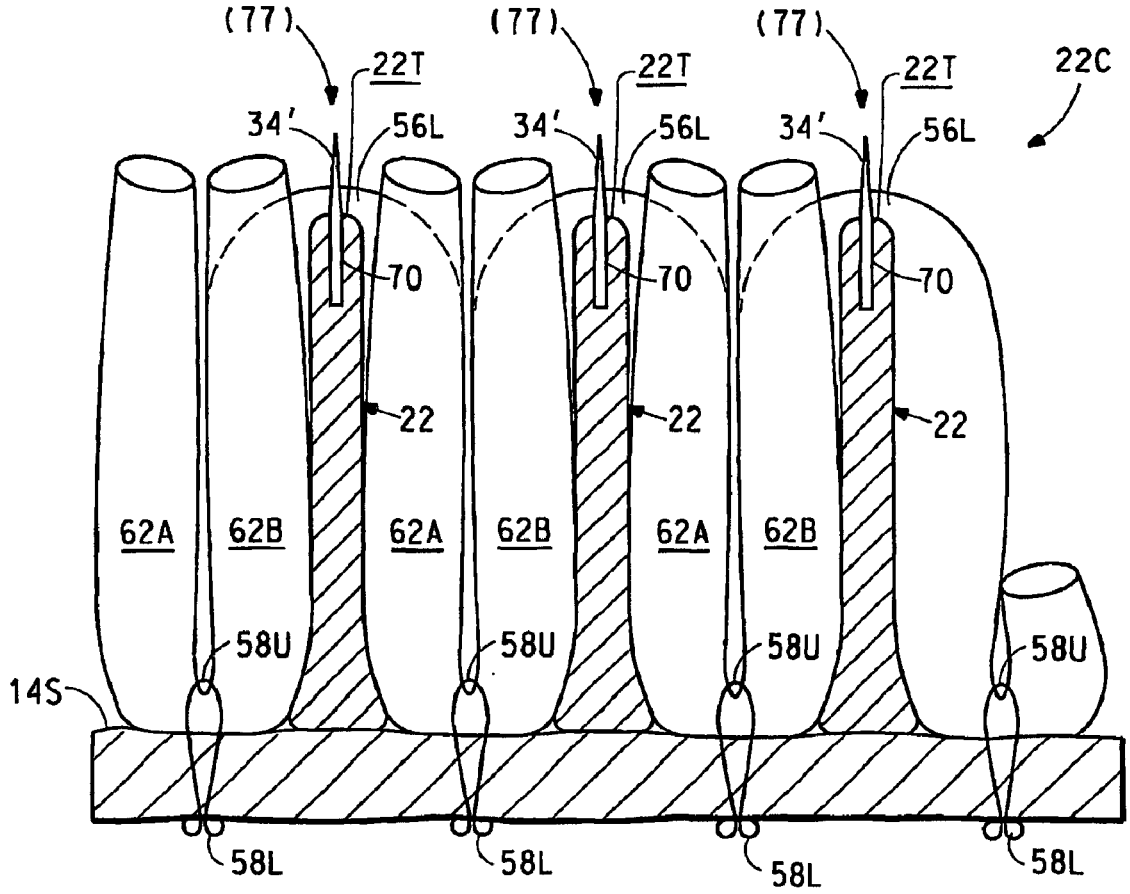
FIGS. 5 through 7 are front elevational views also taken along view lines Y—Y in FIGS. 1 and 2 illustrating alternate cutting blade arrangements operable in the loop cutting region of the sinker fingers of FIGS. 1 and 2.
Figure 6:
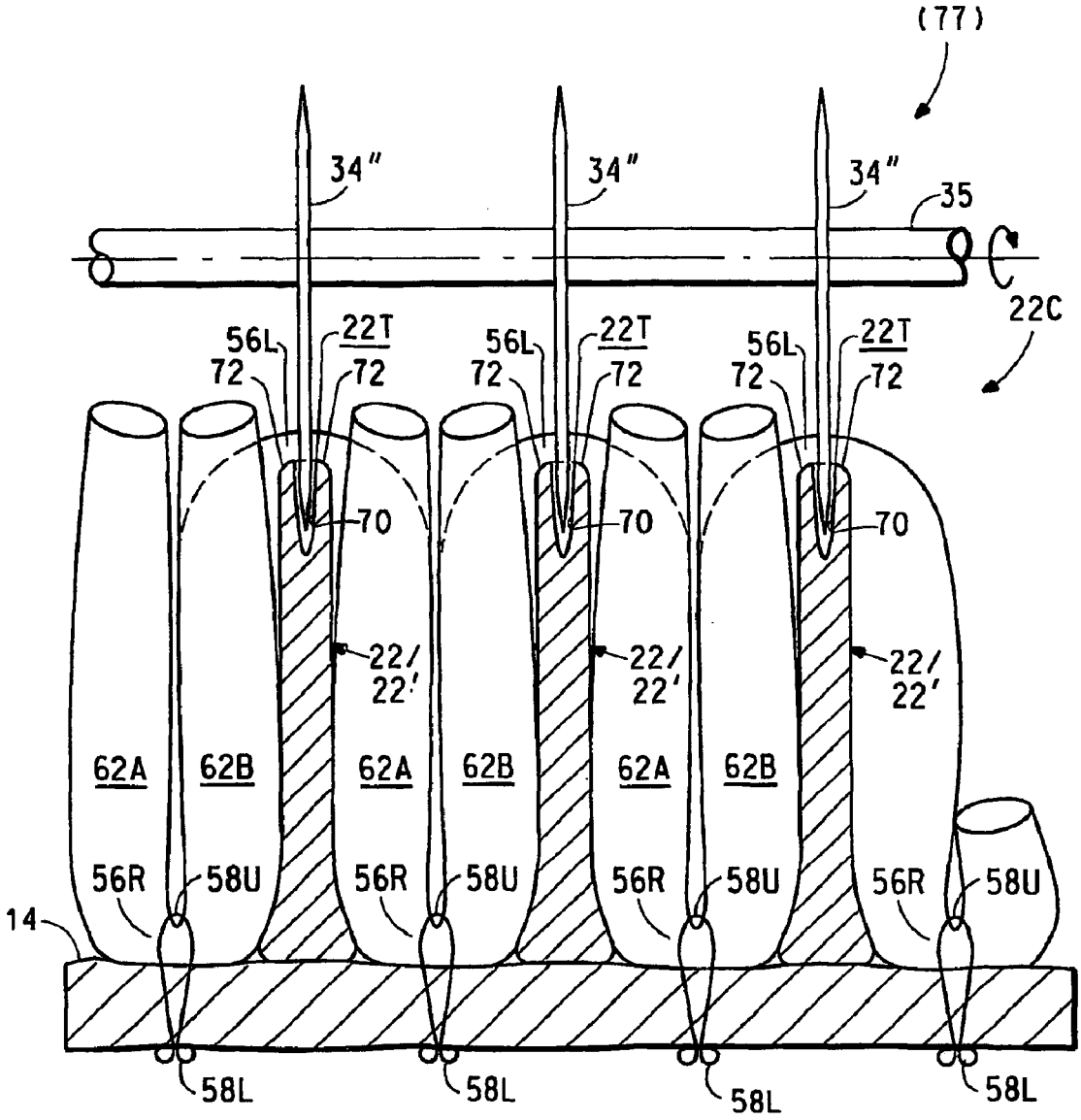
Figure 7:
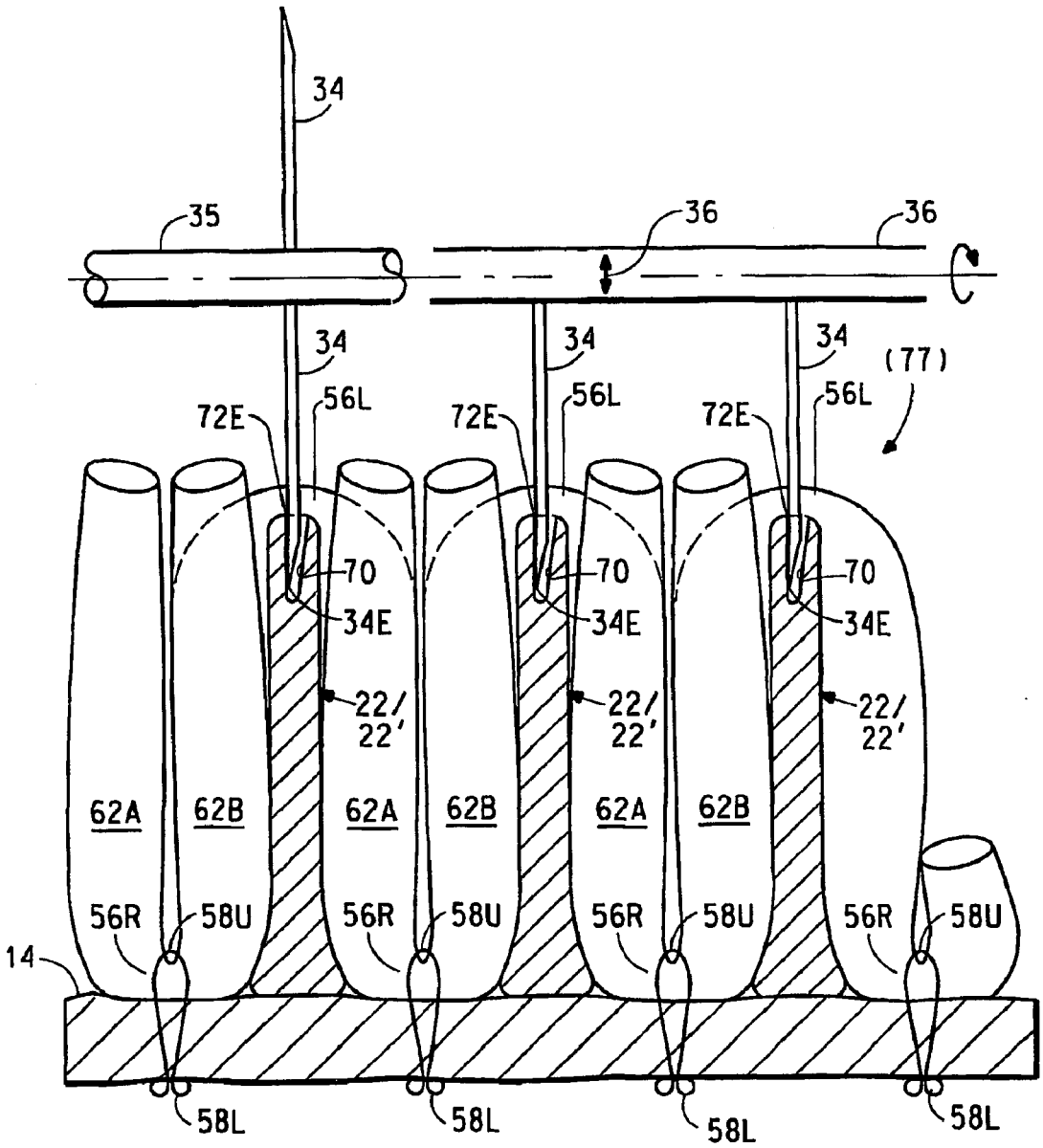

FIGS. 5 through 7 illustrate alternate cutting blade arrangements that may be utilized in accordance with the first embodiment of the present invention.

In the arrangement illustrated in FIG. 5 the top surface 22T of the sinker finger 22 exhibits the rounded-corner cross-section configuration through the cutting region 22C. However, the top surface 22T of the sinker finger 22 is interrupted by a slit 70. The slit 70 extends a predetermined distance in the machine direction along the top surface 22T near to the second end 22D. A cutting blade 34' is mounted in the slit 70. The cutting blade 34' has a generally sawtooth, or upwardly inclined, configuration (in the machine direction). As the pile loop 56L advances along the top surface 22T of the finger 22 in the cutting region 22C it encounters the blade 34', which severs the loop at its apex, forming the branches 62A, 62B. The cutting action in this arrangement occurs from the inside to the outside of the loop.

In the arrangement shown in FIG. 6 the top surface 22T of the finger 22 is again provided with the slit 70. The slit 70 defines a pair of edges 72 in the upper surface of the finger. A cutting blade 34" is carried on a rotating shaft 35. The cutting edge 34"E of the blade 34" extends into the slit 70. As the pile loops advance into the cutting region 22C along the surface 22T of a finger 22 the loops are cut by the blade 34". As illustrated in FIG. 6, at least some portion of the cutting blade 34" penetrates into the slit 70.

In an alternative arrangement shown in FIG. 7 one of the edges formed by the slit 70, e.g. the edge 72E, is sharpened, thereby to define an "interior" cutting edge on the finger 22. In the arrangement the cutting blade 34 is again carried on the reciprocating arm 36. As a cutting blade 34 reciprocates in the directions 36 the edge 34E of the blade 34 acts against 35 the sharpened interior cutting edge 72E on the finger 22, resulting in the loop 56L being severed. As yet a further alternative, the cutting blade 34 may be carried on a rotating shaft 35 (similar to the arrangement of FIG. 6) such that the edge 34E of the blade 34 acts against the sharpened interior cutting edge 72E on the finger 22 to sever the loop 56L.

Reverting to FIGS. 1 and 2, the stitching apparatus 10 may further include a sensing arrangement generally indicated by the reference character 76 to provide an indication of the inoperability of the cutting blade, regardless of the form of cutting blade utilized. To this end the sensing arrangement 76 includes a sensing member, or arm, 76A having an indicator flag 76I thereon. The sensing arm 76A is movably mounted to a support trunnion 76T that is itself connected to the support member 24. The sensing arm 76A is movable with respect to the sinker finger 22 a first, repose, position (shown in solid lines in FIGS. 1 and 2) to a second, signaling, position (shown in the dashed lines in those Figures).

In operation, in the repose position the free end 76F of the sensing arm 76A lies adjacent to a sensing point 22P on the sinker finger 22. The sensing point 22P is suitably located at any on the sinker finger 22 intermediate the cutting location (i.e., the location in the cutting region at which the cutting blade operates) and the second end 22D of sinker finger 22. If the cutting blade is inoperative for any reason a pile loop will survive on the sinker finger 22 beyond the point of operation of the blade. The sensing arm 76A is responsive to the presence of a pile loop 56L at the sensing point 22P by moving from the repose position to the signaling position. The movement of the sensing arm 76A to the signaling position disposes the indicator flag 76I in a location visible to an observer. Alternatively, an electronic indicating arrangement may be provided that includes a light source and an associated receiver. For example, (as diagrammatically indicated in FIG. 1), in the signaling position the indicator flag 76I may interrupt the beam path between the source 76S and receiver 76R, thereby to indicate to an operator or to an automated control system of the inoperability of the blade. Any suitable alternative form of electric, electronic or other indicator apparatus that is actuated by the movement of the sensing arm 76A to the signaling position may be used.

FIGS. 8 through 11 illustrate a second embodiment of the stitching apparatus 10' in accordance with the present invention. In this embodiment each sinker finger 22' is arcuate in shape over at least a portion of its length. However, with this embodiment of the invention the finger 22' extends cantilever fashion from its point of attachment to the sinker bar 18 such that the second end 22'D remains free. That is, the end 22'D of the finger 22' is not attached to a support member as is the case of the fingers 22 in accordance with the first embodiment of the invention (FIGS. 1 through 7). The apparatus 10' further includes a loop cutter 77 (to be described) that is cooperably associated with the arcuate sinker finger adjacent the free end 22'D thereof for cutting pile loops formed on the finger.

Figure 8:
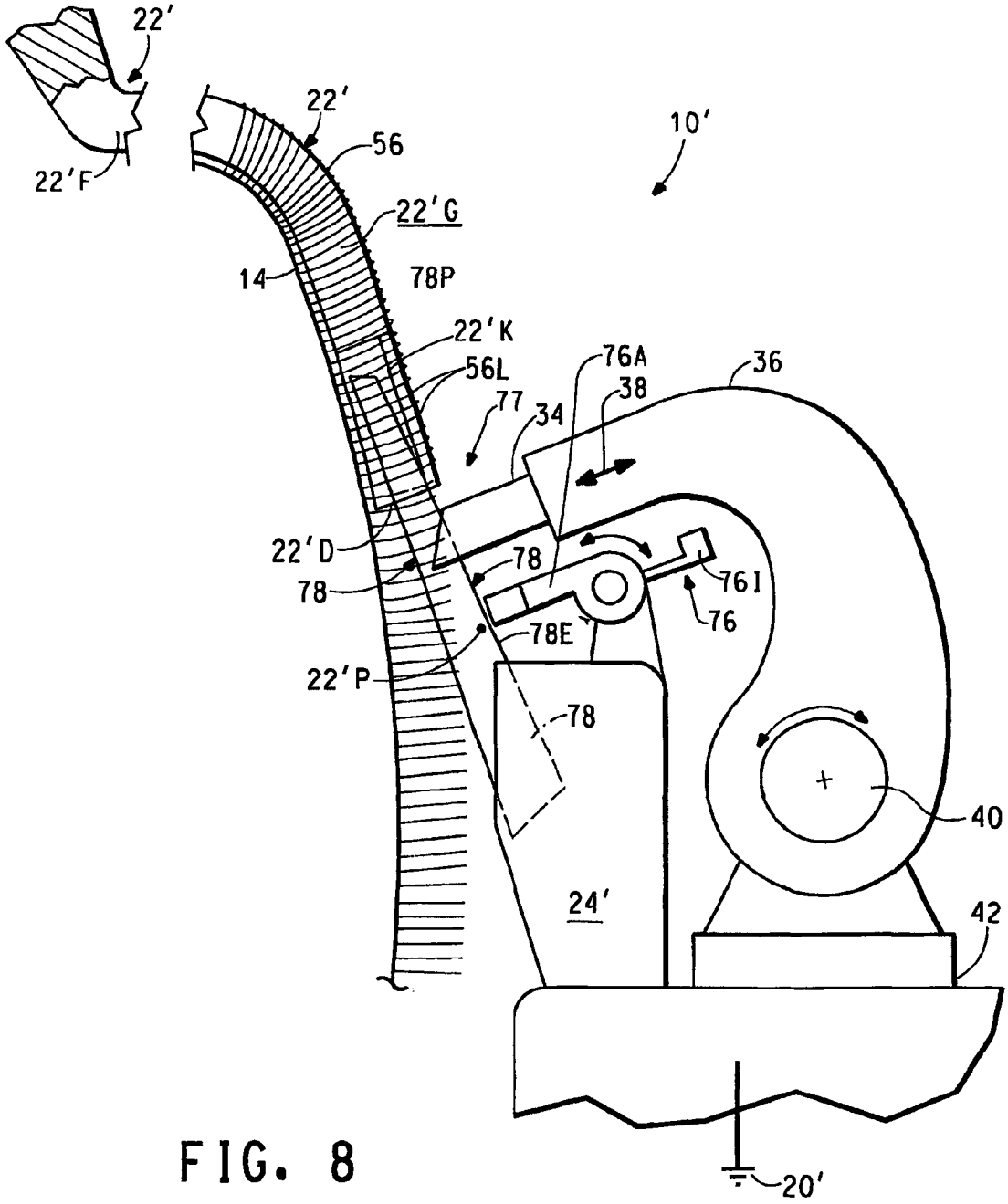
FIG. 8 is a side elevational view of a second embodiment of a stitching apparatus in accordance with the present invention in which an arcuate sinker finger extends in cantilever fashion from the sinker bar and has a loop cutter adjacent to the free end thereof.
Figure 9:
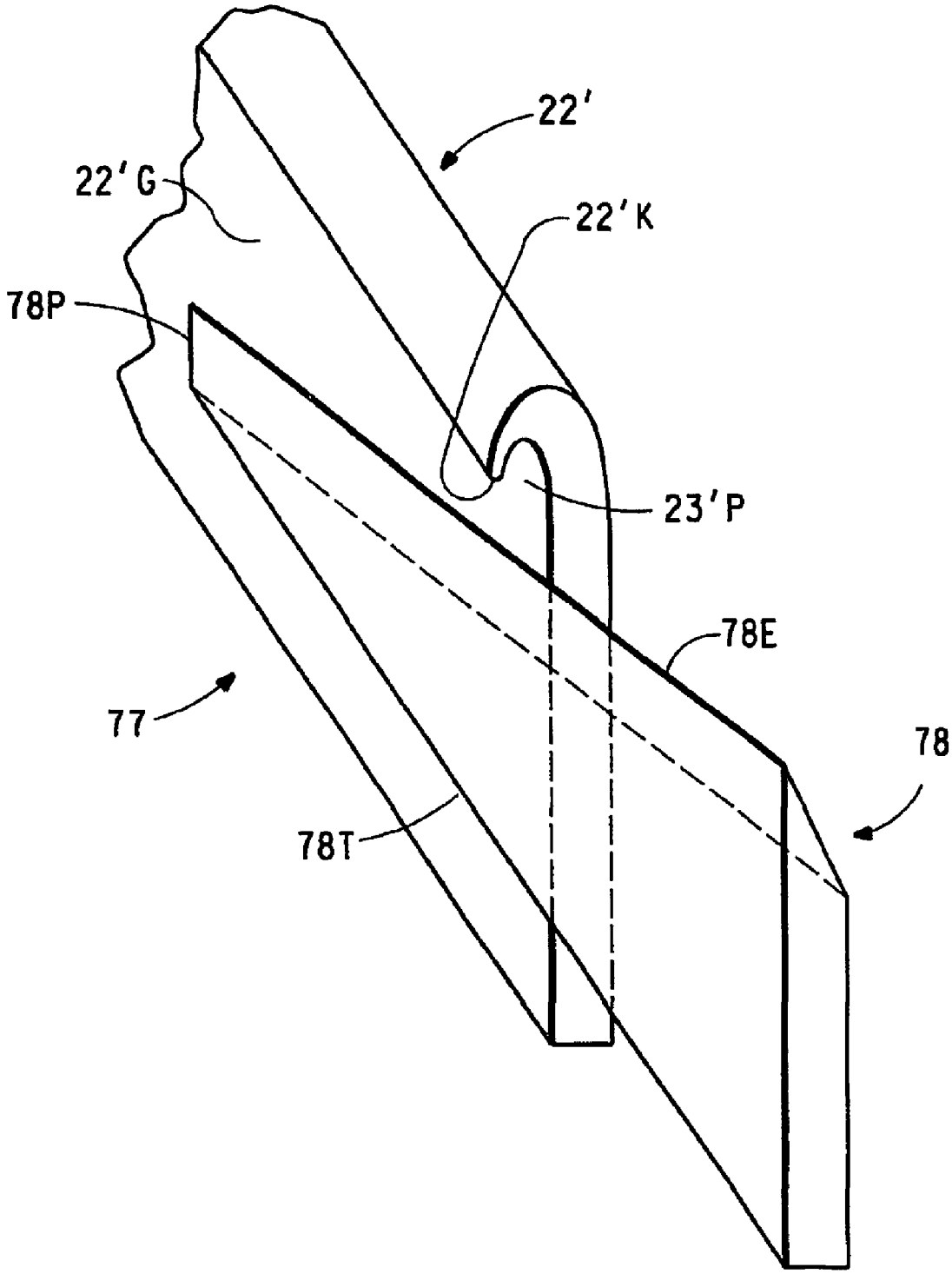
FIG. 9 is an isolated perspective view of the mated engagement of the free end of the sinker finger in accordance with the second embodiment of the stitching apparatus shown in FIG. 8 and a preferred implementation of a loop cutter for use therewith.
Figure 10:
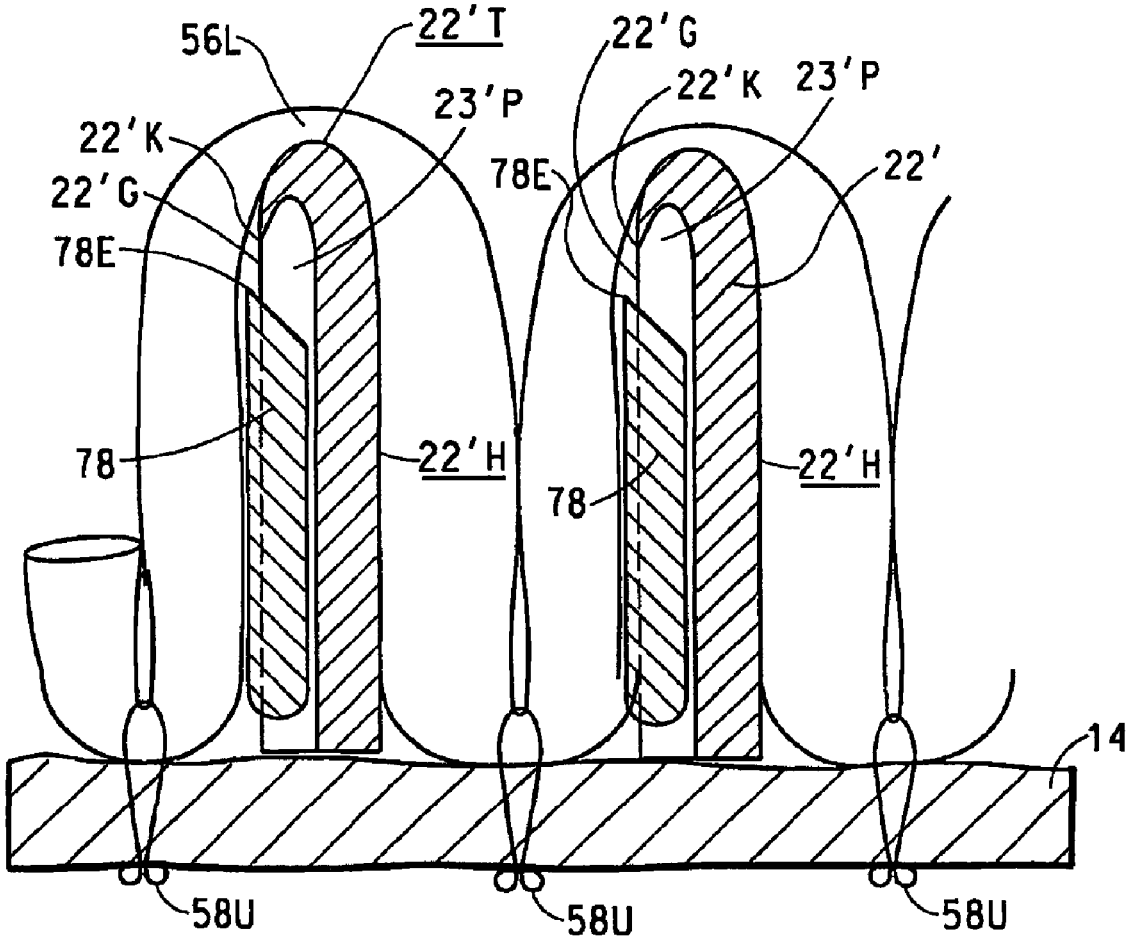
FIGS. 10 and 11 are front elevational views respectively taken along view lines X'—X' and Y'—Y' in FIG. 8, the latter view illustrating the shearing action of the cutting blades in accordance with the preferred implementation of the second embodiment of the present invention.
Figure 11:
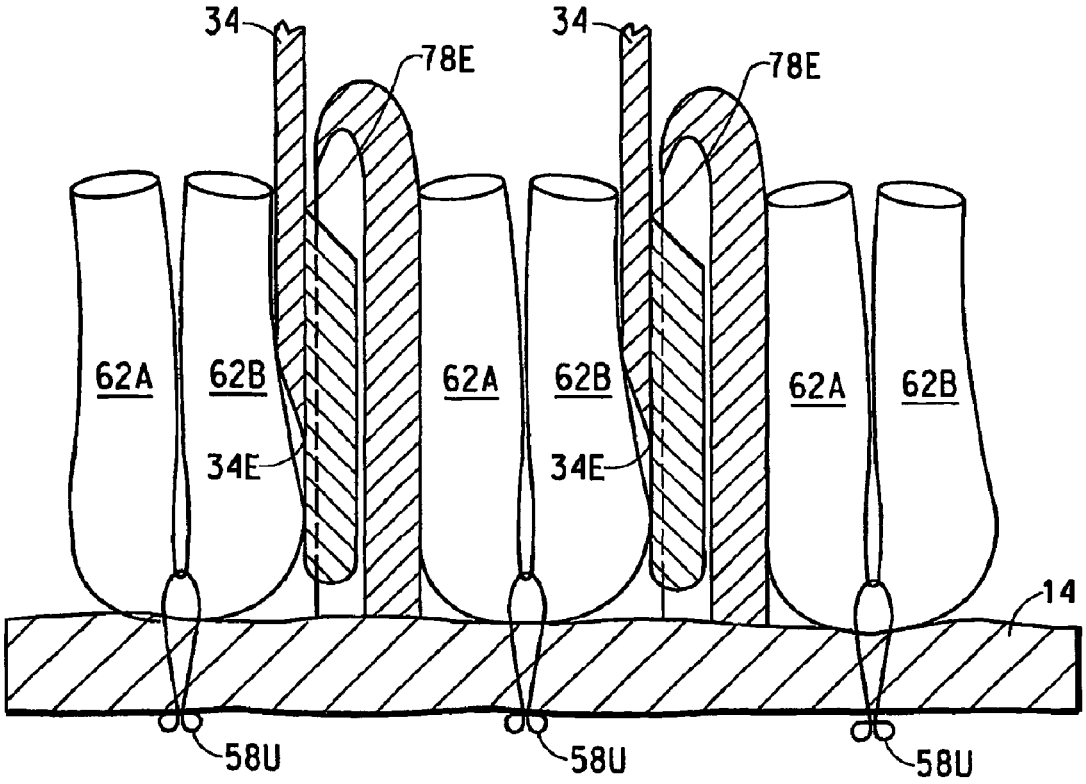

FIGS. 9 through 11 illustrate the preferred form of loop cutter for a cantilevered arcuate sinker finger 22' (FIG. 8). As shown in FIGS. 9 and 10 one lateral surface of the sinker finger 22', e.g., the surface 22'G, is recessed adjacent the free end 22'D thereby to define a depression 23'P therein. The recess defining the depression 23'P undercuts the top surface 22'T to form a lip 22'K that runs along a portion of the length of the finger 22' near its free end 22'D.

In the embodiment shown in FIGS. 9 through 11 the loop cutter 77 includes an array of first cutting blades 78 that is mounted into a support housing 24'. The support housing 24' is connected into the framework of the apparatus, as suggested by the reference character 20'). Each of first cutting blades 78 is respectively associated with a sinker finger 22'. Each first cutting blade 78 has a cutting edge 78E formed thereon. The height of the first cutting blade 78 decreases through a tapered region 78T that narrows the cutting blade 78 to its smallest height dimension at its point 78P. As seen in FIG. 9 a portion of each first cutting blade 78 (e.g., the tapered region 78T) is receivable in a nested relationship within the depression 23'P in the sinker finger 22'. Each first cutting blade 78 lies generally parallel to and is supported in facial relationship against the surface 22'G of the finger 221. Owing to the support 24' each first cutting blade 78 is "fixed" (i.e., not movable) with respect to the finger 22' with which it is nested. Alternatively each first cutting blade 78 may be mounted to an actuator (not shown) for reciprocating movement with respect to the sinker finger 22' in a plane parallel to the depressed lateral surface 22'G, as suggested by the arrows 82 in FIG. 8. Any suitable actuator, e.g., an actuator similar to the actuator 40, may be used to reciprocate the blade in the plane parallel to the lateral surface 22'G.

This embodiment of the loop cutter 77 also includes the array of cutting blades 34 mounted to the cutting arm 36. As earlier described (FIGS. 1 through 7) the cutting arm 36 is itself mounted to the actuator 40 for reciprocating movement in the direction of the arrows 38.

In operation, pile loops 56L (FIG. 8) are drawn over the top surface 22'T of the finger 22' and are attached to the backing 14 by the underlaps 58U of the chain stitches 58 in the same manner as described in connection with FIGS. 1 and 2. As the backing 14 is advanced through the apparatus 10' (through the action of the wind-up 16) the loops 56L ride on the top surface 22'T toward the free end 22'D of each finger 22' (FIG. 8). Owing to the longitudinally overlapped, laterally nested engagement between the first blade 78 in the depression 23' n the finger 22', as the loops 56L approach the free end 22'D of the finger 22' the tapered end 78T of the first blade 78 (nested within the depression 23' in the finger 22') becomes insinuated within the interior of the pile loops 56L. Thus, as seen in FIG. 10, the loops 56L surround both the first blade 78 and the finger 22'. Still further advancement of the backing 14 moves the loops 56L past the free end 22'D of the finger 22' and totally onto the first blade 78.

As may be appreciated from the FIGS. 8, 10 and 11, as the backing 14 advances through the apparatus 10' each loop 56L is initially trained over and surrounds only the structure of a finger 22'. The loop then moves through a transition region where it encloses the nested arrangement of both the finger 22' and the first blade 78. Finally, each loop 56L passes onto and is supported on only the first blade 78.

The cutting edge 34E on the movable blade 34 acts against the cutting edge 7SE on the first blade 78 to sever the pile loop element 54 (FIG. 11) trained over the first blade 78. The cooperative shearing interaction of the first blade 78 and the movable cutting blade 34 severs the pile loop 56L to produce the pair of cut pile branches 62A, 62B emanating from the generally U-shaped root portion 56R.

Although not illustrated it should be appreciated that the arrangement of the loop cutter 77 as shown in FIGS. 9 through 11 may also be used in conjunction with a linear (i.e., non-arcuate) cantilevered sinker finger.

As an alternative to the loop cutter 77 shown in FIGS. 9 through 11, if desired, the loop cutter may be implemented using any of the cutting blade arrangements shown in FIGS. 5 through 7. That is to say, the finger 22' may be provided with a slit 70 with a stationary blade 34' mounted in the slit, in the same manner as is illustrated in FIG. 5. Alternatively, as illustrated in FIG. 6, a cutting blade 34" may be rotationally mounted to a shaft 35 so as to penetrate into the slit 70 to sever the loop 56L. As a still further alternative, an edge 72E defined by the slit 70 in the top surface of the finger 221 may be sharpened to define a cutting edge and a reciprocating blade 34, may be mounted in a position to act against the sharpened edge.

To permit the use of any of the alternatives depicted in FIGS. 5 through 7 the arcuate sinker finger 22' must exhibit sufficient rigidity to hold its position in space. Thus, the alternatives depicted in FIGS. 5 through 7 are suitable with relatively small gauge fingers in which relatively larger distances are defined between sinker fingers, thereby allowing the use of heavier and stiffer sinker fingers.

As a yet further alternative (not directly illustrated), assuming that the cantilevered arcuate sinker fingers 22' have sufficient rigidity, it may be desirable to provide a cutting edge over a portion of the finger itself, adjacent to the free end 22'F, in a manner reminiscent to the cutting edge 22E formed on the cutting region located near the second end 22D of the fingers 22 shown in FIGS. 1 and 2. In this instance the reciprocating blades 34 would then act against the cutting edge formed on the cantilevered arcuate sinker finger 22'.

The sensing arrangement 76 may also be used with any of the loop cutters provided for the arcuate cantilevered sinker fingers. The application of the sensing arrangement 76 to the embodiment of the loop cutter 77 comprised of the first cutting blades 78, 34 is illustrated in FIG. 8. In this instance, when in the repose position, the free end 76F of the sensing arm 76A lies close to a sensing point 22'P defined on the first cutting blade 78 at a point intermediate the location at which the blade 34 acts against the blade 78 and the end of the first blade supported in the support member 24'.

Those skilled in the art, having the benefit of the teachings of the present invention, as hereinabove set forth, may effect numerous modifications thereto. It should be understood that all such modifications lie within the contemplation of the present invention as defined by the appended claims.

What is claimed is:

1. A stitching apparatus comprising:

a sinker bar;

a unitary sinker finger having a first end and a second end, the sinker finger being attached at its first end to the sinker bar and being attached at its second end to a fixed support member, the sinker finger having a loop formation region and a loop cutting region disposed thereon, the loop cutting region being disposed intermediate the loop formation region and the second end of the finger; and a cutting blade, the cutting blade being operable in the cutting region for cutting pile loops formed on the loop formation region of the finger, wherein the sinker former is generally arcuate and the arcuate sinker finger has a slit formed therein near the second end thereof.

2. The stitching apparatus of claim 1 wherein the sinker finger is generally linear.

3. The stitching apparatus of claim 1 wherein the finger has a cutting edge formed thereon in the loop cutting region, and wherein the cutting blade is reciprocally moveable with respect to the cutting edge such that a loop formed in the loop formation region is advanceable onto the cutting edge and is thereon cut by the cooperative interaction of the cutting blade and the cutting edge.

4. The stitching apparatus of claim 1 wherein, the cutting blade is mounted in the slit in the sinker finger.

5. The stitching apparatus of claim 1 wherein, the cutting blade is rotatably mounted with respect to the sinker finger such that a loop formed in the loop formation region is advanceable into the cutting region and is thereon cut by the cutting blade, at least some portion of the cutting blade penetrating into the slit while cutting a pile loop.

6. The stitching apparatus of claim 1 wherein the arcuate sinker finger has a slit formed therein near the second end thereof, the slit forming a pair of cutting edges in the sinker finger, and wherein, the cutting blade is reciprocally mounted with respect to the sinker finger such that a pile loop formed in the loop formation region is advanceable into the cutting region and is thereon cut by the cooperative interaction of the cutting blade against at least one cutting edge.

7. The stitching apparatus of claim 1 wherein the arcuate sinker finger has a slit formed therein near the second end thereof, the slit forming a pair of cutting edges in the sinker finger, and wherein, the cutting blade is rotatably mounted with respect to the sinker finger such that a loop formed the loop formation region is advanceable into the cutting region and is thereon cut by the cooperative interaction of the rotatable cutting blade acting against at least one cutting edge.

8. The stitching apparatus of claim 1 further comprising;

a sensing member having a free end thereon, the sensing member being movably mounted with respect to the sinker finger from a first, repose, position to a second, signaling, position, in the repose position the free end of the sensing member being disposed adjacent to a sensing point on the sinker finger intermediate the cutting blade and the second end of the sinker finger, the sensing member being responsive to the presence of a pile loop on the sinker finger at the sensing point by moving from the repose position to the signaling position.

9. The stitching apparatus of claim 8 further comprising:

an indicating arrangement comprising a light source and a light receiver, and wherein movement of the sensing arm to the signaling position disposing the arm in a beam path extending between the source and the receiver.

10. The stitching apparatus of claim 8 wherein the sensing member has an indicator thereon, movement of the sensing member to the signaling position disposing the indicator to a location visible to an observer.

11. A stitching apparatus comprising:

a sinker bar;

a sinker finger having a fixed end and a free end, the sinker finger being attached at its fixed end to the sinker bar, the sinker finger being arcuate in shape over a portion of its length the arcuate sinker finger has a lit formed therein near the free end thereof; and a loop cutter cooperable with the arcuate sinker finger adjacent to the free end thereof for cutting pile loops formed on the finger.

12. The stitching apparatus of claim 11 wherein the sinker finger has a cutting edge formed thereon adjacent to the free end thereof, and wherein the cutting blade is reciprocally moveable with respect to the cutting edge, such that a loop advanceable onto the cutting edge is cut by the cooperative interaction of the cutting blade and the cutting edge.

13. The stitching apparatus of claim 11 the arcuate sinker finger has a slit formed therein near the free end thereof, and wherein, the loop cutter comprises a cutting blade mounted in the slit in the sinker finger.

14. The stitching apparatus of claim 11 wherein the arcuate sinker finger has a slit formed therein near the free end thereof, and wherein, the loop cutter comprises a cutting blade rotatably mounted with respect to the sinker finger such that a loop advanceable over the slit is cut by the cutting blade, at least some portion of the cutting blade penetrating into the slit while cutting a pile loop.

15. The stitching apparatus of claim 11 wherein the arcuate sinker finger has a slit formed therein near the free end thereof, the slit forming a pair of cutting edges in the sinker finger, and wherein, the loop cutter comprises a cutting blade reciprocally mounted with respect to the sinker finger such that a pile loop advanceable over the slit is cut by the cooperative interaction of the cutting blade against at least one cutting edge.

16. The stitching apparatus of claim 11 wherein the arcuate sinker finger has a slit formed therein near the second end thereof, the slit forming a pair of cutting edges in the sinker finger, and wherein the cutting blade is rotatably mounted with respect to the sinker finger such that a loop formed in the loop formation region is advanceable into the cutting region and is thereon cut by the cooperative interaction of the rotatable cutting blade acting against at least one cutting edge.

17. The stitching apparatus of claim 11 wherein the sinker finger has a first and second lateral surface thereon, the sinker finger is recessed adjacent to the free end to define a depression in one lateral surface thereof; and wherein the loop cutter comprises:

a first cutting blade and a second cutting blade; the first cutting blade having a free end, the free end of the first cutting blade being receivable within the depression in the lateral surface of the sinker finger, the first cutting blade being fixed with respect to the finger; and the second cutting blade being reciprocably moveable with respect to the first cutting blade, such that a loop formed on the sinker finger is advanceable onto the first cutting blade and is thereon severed by the cooperative interaction of the first and second cutting blades.

18. The stitching apparatus of claim 17, further comprising:

a sensing member having a free end thereon, the free end of the sensing member being movably mounted with respect to the first cutting blade from a first, repose, position to a second, signaling, position, in the repose position the free end of the sensing member be disposed adjacent to a sensing point on the first cutting blade, the sensing member being responsive to the presence of a pile loop on the sinker finger at the sensing point by moving from the repose position to the signaling position.

19. The stitching apparatus of claim 18 further comprising:

an indicating arrangement comprising a light source and a light receiver, and wherein movement of the sensing arm to the signaling position disposing the arm in a beam path extending between the source and the receiver.

20. The stitching apparatus of claim 18 wherein the sensing member has an indicator thereon, movement of the sensing member to the signaling position disposing the indicator to a location visible to an observer.

21. A stitching apparatus having:

a sinker bar; and a sinker finger having a fixed end and a free end and a first and second lateral surface thereon, the sinker finger being attached at its fixed end to the sinker bar;

wherein the improvement comprises:

the sinker finger being recessed adjacent to the free end to define a depression in one lateral surface thereof;

a first cutting blade having a free end, the free end of the first cutting blade being receivable within the depression in the lateral surface of the sinker finger; and a second cutting blade, the second cutting blade being reciprocably moveable with respect to the first cutting blade, such that a loop formed on the sinker finger is advanceable onto the first cutting blade and is thereon severed by the cooperative interaction of the first and second cutting blades.

22. The stitching apparatus of claim 21 wherein the sinker finger is generally linear.

23. The stitching apparatus of claim 21 wherein the sinker finger is generally arcuate.

24. The stitching apparatus of claim 21 wherein the first cutting blade is fixed with respect to the sinker finger.

25. The stitching apparatus of claim 21 wherein the first cutting blade is reciprocably moveable with respect to the sinker finger in a plane parallel to the depressed lateral surface.

26. The stitching apparatus of claim 21 further comprising:

a sensing member having a free end thereon, the free end of the sensing member being movably mounted with respect to the first cutting blade from a first, repose, position to a second, signaling, position, in the repose position the free end of the sensing member being disposed adjacent to a sensing point on the first cutting blade, the sensing member being responsive to the presence of a pile loop on the first cutting blade at the sensing point by moving from the repose position to the signaling position.

27. The stitching apparatus of claim 26 further comprising:

an indicating arrangement comprising a light source and a light receiver, and wherein movement of the sensing arm to the signaling position disposing the arm in a bean path extending between the source and the receiver.

28. The stitching apparatus of claim 26 wherein the sensing member has an indicator thereon, movement of the sensing member to the signaling position disposing the indicator to a location visible to an observer.

* * * * *